US010844550B2

(12) United States Patent
Vargas et al.

(10) Patent No.: US 10,844,550 B2
(45) Date of Patent: Nov. 24, 2020

(54) WORKHEAD ASSEMBLY FOR RAIL APPLICATIONS

(71) Applicant: HARSCO TECHNOLOGIES LLC, Fairmont, MN (US)

(72) Inventors: Victor Vargas, Camp Hill, PA (US); Rob Alford, Camp Hill, PA (US); Reza Sami, Camp Hill, PA (US)

(73) Assignee: HARSCO TECHNOLOGIES LLC, Fairmont, MN (US)

( * ) Notice: Subject to any disclaimer, the term of this patent is extended or adjusted under 35 U.S.C. 154(b) by 57 days.

(21) Appl. No.: 16/129,292

(22) Filed: Sep. 12, 2018

(65) Prior Publication Data

US 2019/0010665 A1 Jan. 10, 2019

Related U.S. Application Data

(63) Continuation of application No. 15/192,483, filed on Jun. 24, 2016, now Pat. No. 10,125,456.

(60) Provisional application No. 62/191,156, filed on Jul. 10, 2015.

(51) Int. Cl.
*E01B 27/16* (2006.01)

(52) U.S. Cl.
CPC ..... *E01B 27/16* (2013.01)

(58) Field of Classification Search
CPC ..... E01B 27/16; E01B 2203/12; E01B 2203/125; E01B 2203/122
USPC ..... 104/10, 17.2
See application file for complete search history.

(56) References Cited

U.S. PATENT DOCUMENTS 1,740,538 A * 12/1929 Connelly ..... E01B 27/16 104/12
3,012,516 A * 12/1961 Allemann ..... E01B 27/16 104/12
3,016,023 A 1/1962 Franz et al.
3,357,366 A 12/1967 Franz et al.
4,068,595 A * 1/1978 Weber ..... B06B 1/18 104/12

(Continued)

FOREIGN PATENT DOCUMENTS

CH 321786 A 5/1957
CH 583336 A5 12/1976

(Continued)

OTHER PUBLICATIONS

An extended European search report issued by the European patent office dated Jan. 24, 2019 in connection with European patent application No. 16824881.3.

(Continued)

*Primary Examiner* — Mark T Le
(74) *Attorney, Agent, or Firm* — Norton Rose Fulbright US LLP

(57) ABSTRACT

A workhead assembly for use in rail applications may comprise a frame and two pairs of workheads, wherein each pair of workheads is disposed on opposing sides of the frame and carries tamping tools. The workhead assembly may further include two vertically-oriented actuators being disposed on opposing sides of the frame. Two pairs of linkage arms are coupled between the vertically-oriented actuator and a pair of tamping arms. Each pair of linkage arms are disposed on opposing sides of the frame. Actuation of the linkage arms imparts movement to the tamping tools.

14 Claims, 10 Drawing Sheets

(56) References Cited

U.S. PATENT DOCUMENTS

| | | | |
|---|---|---|---|
| 4,369,712 | A | 1/1983 | von Beckmann |
| 4,598,645 | A | 7/1986 | Ganz |
| 5,269,226 | A | 12/1993 | Theurer et al. |
| 2006/0090666 | A1 | 5/2006 | Theurer et al. |
| 2014/0076440 | A1 | 3/2014 | Chaika |

FOREIGN PATENT DOCUMENTS

| | | | |
|---|---|---|---|
| EP | 1 149 951 | * | 10/2001 |
| EP | 2770108 | A1 | 8/2014 |
| JP | 06185003 | | 7/1994 |
| JP | 07166501 | | 6/1995 |
| JP | 0774483 | | 8/1995 |
| JP | 2004257232 | | 9/2004 |
| KR | 10-2015-0046672 | A | 4/2015 |

OTHER PUBLICATIONS

International Search Report and Written Opinion for co-pending PCT application No. PCT/US2016/040123 dated Oct. 18, 2016.

* cited by examiner

WORKHEAD ASSEMBLY FOR RAIL APPLICATIONS

CROSS-REFERENCE TO RELATED APPLICATION

This application is a Continuation application of U.S. patent application Ser. No. 15/192,483, filed on Jun. 24, 2016, which claims priority to U.S. Provisional Application No. 62/191,156, filed on Jul. 10, 2015, each of which are hereby incorporated by reference in their entirety.

BACKGROUND

Railroads are typically constructed to include a pair of elongated, substantially parallel rails, which are coupled to a plurality of laterally extending ties. The ties are disposed on a ballast bed of hard particulate material, such as gravel. Over time, normal wear and tear on the railroad may require track maintenance operations to correct rail deviations.

Rail vehicles for track maintenance operations include workheads for performing the desired track maintenance, such as ballast tamping, spike pulling, spike driving, anchor spreading, anchor squeezing, track stabilizing, crib booming, tie extracting, or other maintenance operations. Workheads for track maintenance operations have typically been designed to include workheads disposed on one side of a frame for attaching the workheads to the rail vehicle. Workheads for track maintenance operations are typically actuated using hydraulic cylinders. Increasing the number of cylinders increases design complexity, which can lead to failures of the workheads to perform their desired functions. Accordingly, improved workhead designs are desired for reducing design complexity and associated functionality problems that may arise with such design complexity. Further, improved workhead assembly designs are desired to facilitate tamping, including in switch areas and areas with restricted clearance envelope.

BRIEF SUMMARY

The present disclosures relates to a split workhead assembly for use in rail applications. In one embodiment, the split workhead assembly includes a frame and a first pair of workheads disposed on a first side of the frame and a second pair of workheads disposed on the other side of the frame. The split workhead assembly further includes a vertically-oriented actuator attached to a sub frame for imparting vibration. A pair of linkage arms are connected between the vertically-oriented actuator and a pair of tamping arms, pivoting around pivot points on the sub frame, that carry tamping tools (tynes). The linkage arms may comprise mechanical or hydraulic actuators. In this manner, the pair of linkage arms may be actuated to impart motion to the tamping arms and the tamping tools (tynes).

In other embodiments, the vertically-oriented actuator may be removed and the linkage arms may be connected between the sub frame and the tamping arms. In such embodiments, the linkage arms may be hydraulic actuators. In still other embodiments, additional actuators may be connected between the frame and the tamping tools. Related methods are described.

BRIEF DESCRIPTION OF THE DRAWINGS

Exemplary embodiments of the invention are described herein with reference to the drawings, wherein like parts are designated by like reference numbers, and wherein.

DETAILED DESCRIPTION

Various embodiments of an improved workhead design and methods of using such workheads to perform track maintenance operations according to the present disclosure are described. It is to be understood, however, that the following explanation is merely exemplary in describing the devices and methods of the present disclosure. Accordingly, several modifications, changes, and substitutions are contemplated.

In some embodiments, an improved workhead design according to the present disclosure takes the form of a split workhead assembly that includes workheads disposed on both sides of a frame carrying the workheads. The split workhead assembly may be disposed on a variety of track maintenance vehicles for performing various track maintenance operations.

Figure 7:
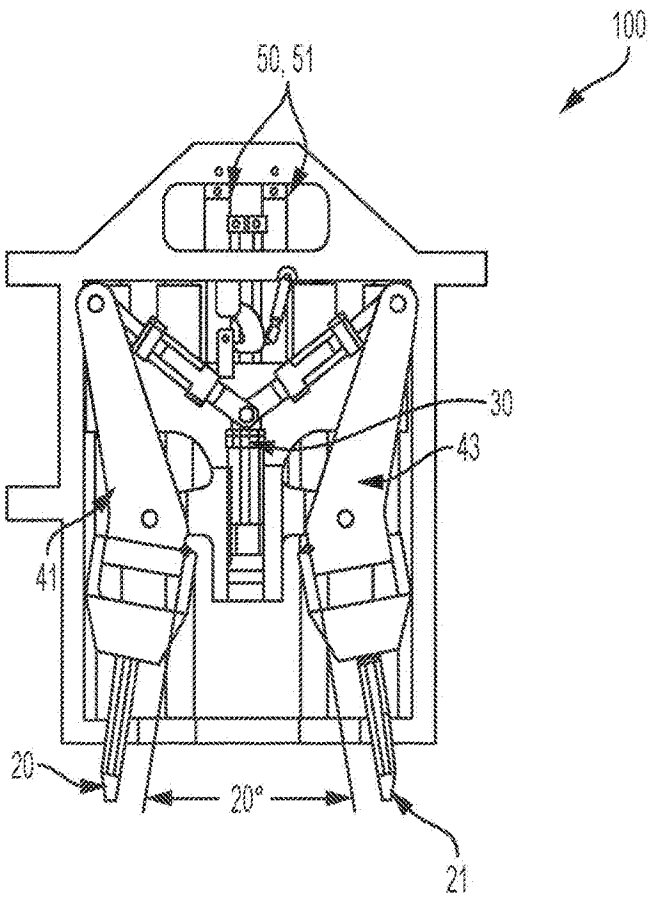
FIG. 7 illustrates a front view of the split workhead assembly of FIG. 6, wherein the tamping tools are tilted away from one another.

Example embodiments are shown in FIGS. 1-17. FIGS. 1-5 illustrate embodiments with pairs of linkage arms actuated by a vertically-oriented hydraulic actuator; FIGS. 6 and 7 illustrate embodiments wherein the linkage arms comprise hydraulic actuators for independent movement of tamping tools; FIGS. 8-12 illustrate embodiments wherein the linkage arms are coupled to a sub frame; and FIGS. 13-17 illustrate embodiments having an additional actuator in a kick embodiment. The linkage arms described herein may take the form of hydraulic actuators. The hydraulic actuators described herein may take the form of hydraulic cylinders, such as single rod linear actuators and double rod actuators.

Figure 1:
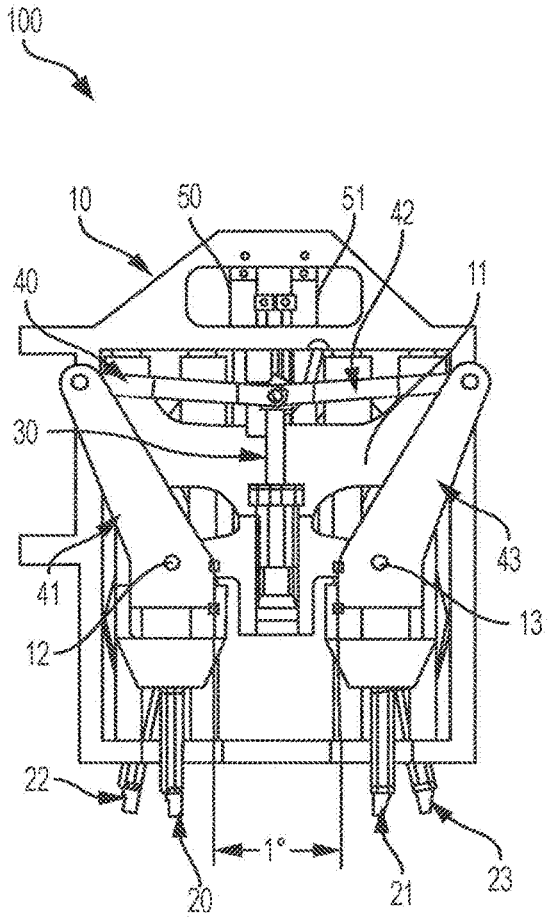
FIG. 1 illustrates a front view of a split workhead assembly with linkage arms operatively coupled to a hydraulic actuator according to one embodiment of the present disclosure.

FIG. 1 is a front view of a workhead assembly 100 having a frame 10 and four tamping tools (tynes) 20, 21, 22, and 23, two of each being disposed on both sides of the frame. In some embodiments, additional tamping tools (tynes) may be provided on each side of the frame 10, such as four tamping tools (tynes) on each side. The workhead assembly 100 further includes opposing linkage arms 40 and 42, which are operatively coupled to a single vertically-oriented hydraulic actuator 30, which is attached to a sub frame 11. In some embodiments, the hydraulic actuator 30 may take the form of a double rod actuator to perform both vibration and squeezing operations. The double rod actuator may be actuated when more hydraulic fluid is displaced within a first chamber of the double rod actuator than a second chamber of the double rod actuator. Displacing more hydraulic fluid within the first chamber of the double rod actuator increases the pressure within the first chamber of the double rod actuator, which thus causes the double rod actuators to translate (e.g., move, slide) along the actuator rod disposed within both the interior of the first and second chambers of the double rod actuator in a first direction.

The linkage arms 40 and 42 are operatively coupled to tamping arms 41 and 43, respectively. In the embodiments of FIGS. 1-5, the linkage arms 40 and 42 are depicted as mechanical actuators. The tamping arms 41 and 43 pivot around pivot points 12 and 13 and carry tamping tools (tynes) 20 and 21. In this arrangement, actuation of the hydraulic actuator 30 extends its length and thereby imparts vibration as well as sweeping movement to linkage arms 40 and 42, which in turn, impart sweeping movement to tamping arms 41 and 43, respectively, to thereby cause vibration and squeezing of the tamping tools (tynes) 20 and 21 in a tamping operation. In this manner, the tamping tools (tynes) can achieve a squeezing angle towards one another up to about 1 degree as measured from a vertical side of the workhead to an axis normal to the rails. It is to be appreciated that the tamping tools (tynes) 22 and 23 on the opposing side of the frame 10 are operated in a similar manner.

Figure 2:
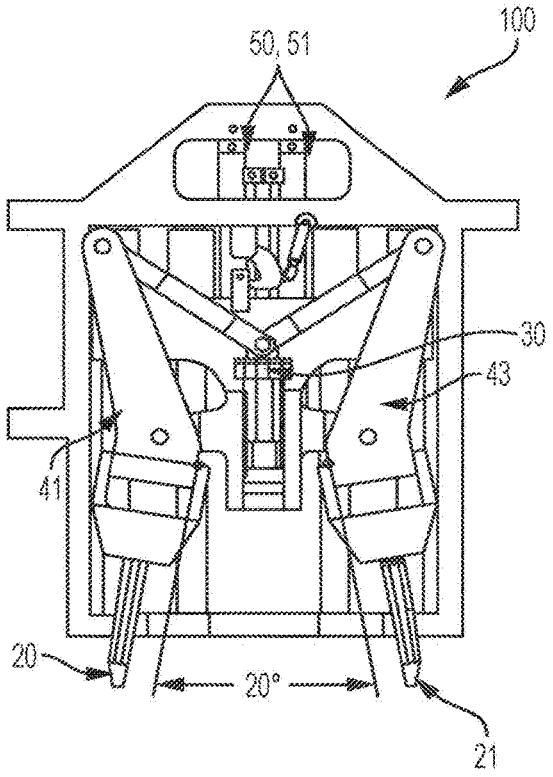
FIG. 2 illustrates a front view of the split workhead assembly of FIG. 1, wherein tamping tools are tilted away from one another.

FIG. 2 is a front view of the workhead assembly 100 showing that the actuator 30 may be actuated to decrease in length to thereby impart movement to the linkage arms 40 and 42, and in turn, tamping arms 41 and 43, respectively, to cause tilting away and opening of the tamping tools (tynes) 20 and 21. In this manner, the workheads can achieve an opening operation in which the workheads are tilted away from one another up to about 20 degrees as measured from a vertical side of the workhead to an axis normal to the rails.

Figure 3:
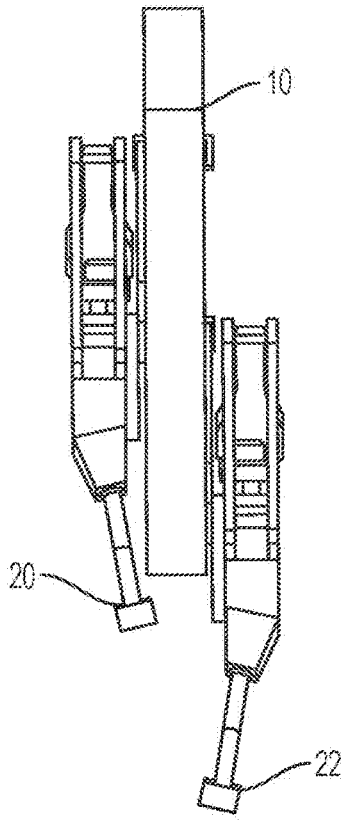
FIG. 3 illustrates a side view of the split workhead assembly of FIG. 1, wherein the tamping tools on either side of the frame are at different vertical positions.
Figure 4:
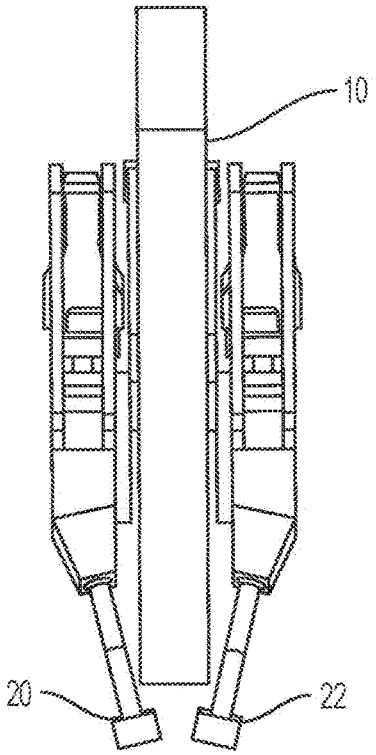
FIG. 4 illustrates a side view of the split workhead assembly of FIG. 1, wherein the tamping tools on either side of the frame are at the same vertical position.
Figure 5:
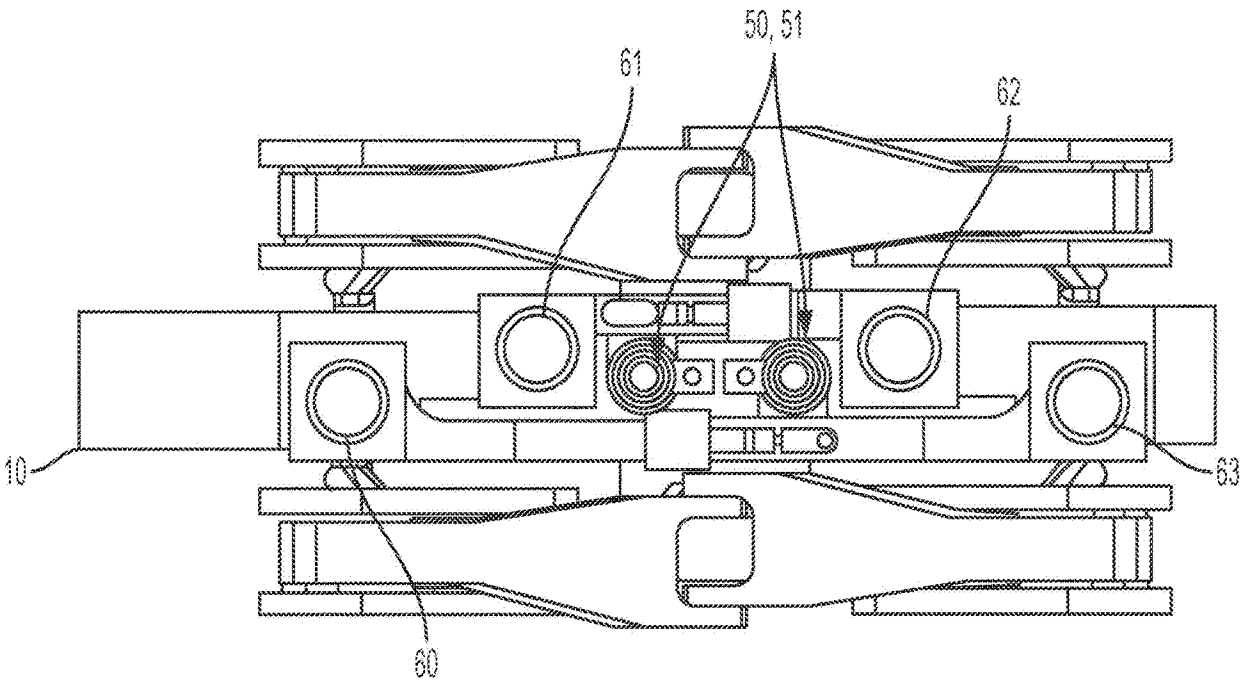
FIG. 5 illustrates a top view of the split workhead assembly of FIG. 1.
Figure 6:
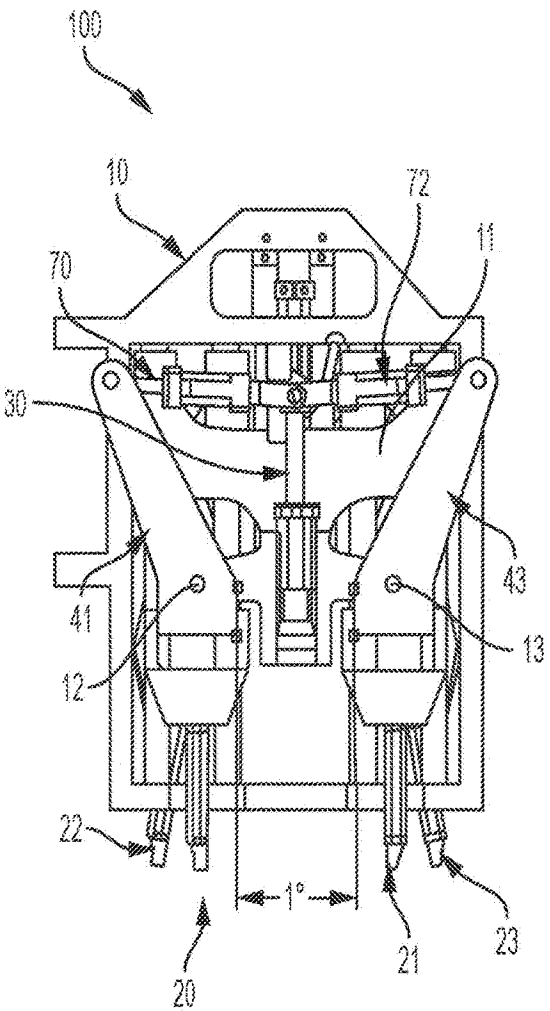
FIG. 6 illustrates a front view of a split workhead assembly wherein the linkage arms comprise hydraulic actuators according to another embodiment of the present disclosure.

The front sub frame, 11, and back sub frame (not shown in FIGS. 1 and 2), are further each coupled to a hydraulic actuator, 50 and 51, as shown in FIGS. 1, 2, and 5, that provides for independent movement of the workheads in the vertical direction. In this manner, the hydraulic actuators 50 and 51 may be actuated to independently lift the workheads (via connection to a workhead frame assembly) on either side of the frame 10 as shown in FIGS. 3 and 4. As such, the split workhead assembly may be used at obstructions along the rail, such as working switches and electrical boxes.

Referring to FIG. 5, each workhead disposed on either side of the frame 10 is operatively coupled to its respective hydraulic actuator, 50 and 51, to achieve independent vertical movement of the workheads. The workhead assembly 100 further includes tubes 60, 61, 62, and 63, which permit the workheads to slide up and down when the hydraulic actuators are actuated for independent vertical movement.

The single vertically-oriented hydraulic actuator used for actuating the workheads in vibrating and squeezing operations according to the present disclosure reduces overall design complexity. Further, utilizing the split workhead design also reduces design complexity by employing four or more tamping tools on a single frame.

In an alternative embodiment, and with reference to FIGS. 6 and 7, the linkage arms 40 and 42 may take the form of hydraulic actuators 70 and 72 to provide for independent movement of the tamping arms 41 and 43 disposed on the same side of the frame 10.

In the embodiment of FIGS. 6 and 7, the vertically-oriented hydraulic actuator 30 may be reduced in size and utilized to impart vibration to the tamping tools to further assist with tamping operations. Further, by using the hydraulic actuators 70 and 72 each tamping arm 41 and 43 may be independently moved, thereby allowing for movement of one of the tamping tools relative to the other tamping tool. This is particularly useful when one of the tamping tools encounters an obstruction during tamping operations. Moreover, the hydraulic actuator 30 may take the form of a hydraulic cylinder, such as a double rod actuator. The hydraulic actuators 70 and 72 may similarly take the form of a hydraulic cylinder, such as a double rod actuator.

In another embodiment, set forth in FIGS. 8-12, a split workhead assembly 200, with a frame 10, includes four tamping tools, 220 and 221, and 222 and 223 (not depicted in FIGS. 8 and 9), two of each being disposed on both sides of the frame. As with previous embodiments, additional tamping tools may be deployed. Each tamping tool is coupled to a tamping arm 240 and 241, which pivots around respective pivot points (212 and 213), and is coupled to a hydraulic actuator (hydraulic cylinders 230 and 231 are shown). In some embodiments, the hydraulic actuators 230 and 231 may take the form of the double rod actuators or the single rod linear hydraulic actuators described previously. The hydraulic actuators 230 and 231 extend between their respective tamping arm 240 and 241 and a sub frame 280 such that actuation of the two actuators results in actuation of the tamping arms, and thus sweeping movement of the tamping tools.

Figures 8, 9:
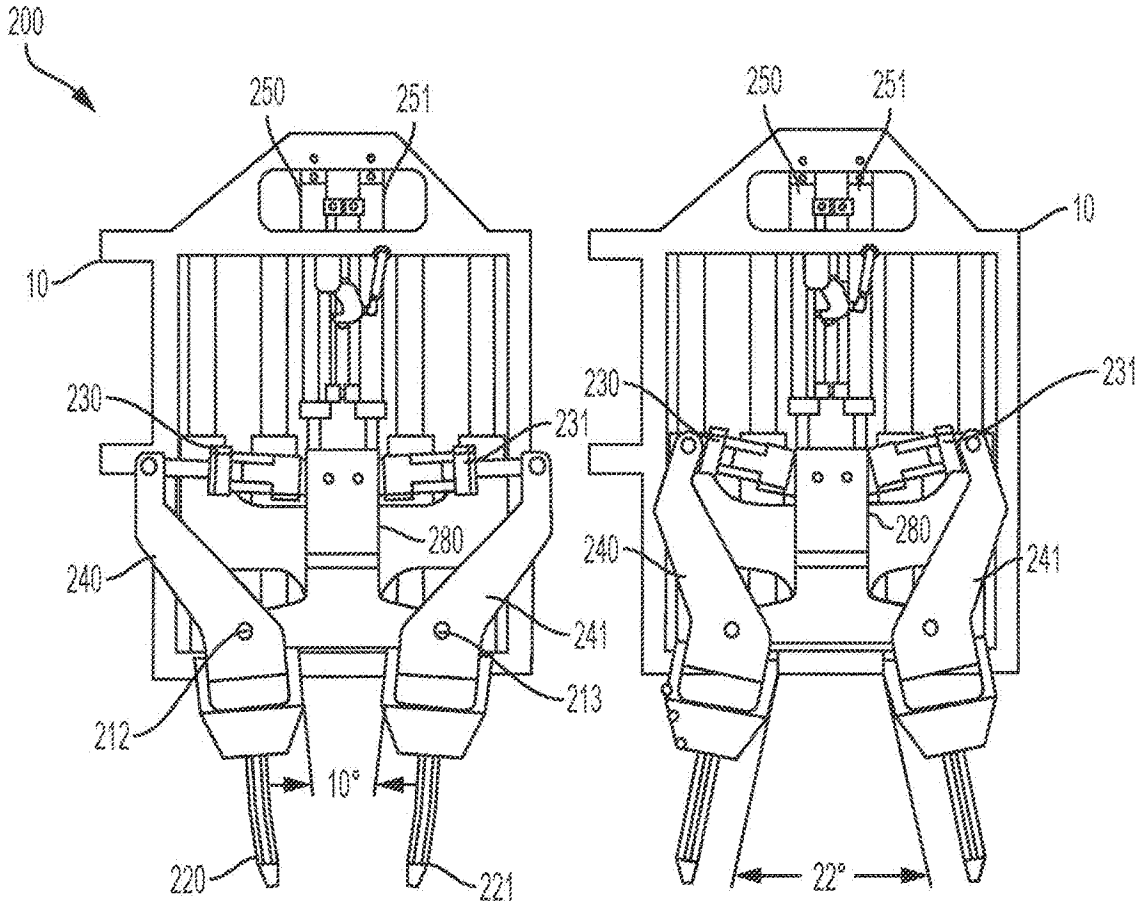
FIG. 8 illustrates a front view of a split workhead assembly with linkage arms operatively coupled to a sub frame according to one embodiment of the present disclosure.
FIG. 9 illustrates a front view of the split workhead assembly of FIG. 8, wherein the tamping tools are tilted away from one another.

As shown in FIG. 8, each hydraulic actuator 230 and 231 is actuated to increase in length to thereby impart movement to the respective tamping arms 240 and 241, and therefore the tamping tools, 220 and 221, to cause vibration and squeezing of the tamping tools in a tamping operation. In this manner, the workheads can achieve a squeezing angle towards one another up to about 10 degrees as measured from a vertical side of the workhead to an axis normal to the rails.

As shown in FIG. 9, the hydraulic actuators 230 and 231 may be actuated to decrease in length to thereby impart movement to the tamping arms 240 and 241 and therefore the tamping tools to cause opening of the tamping tools 220 and 221. In this manner, the workheads can achieve an opening operation in which the workheads are tilted away from one another and opened up to 22 degrees as measured from a vertical side of the workhead to an axis normal to the rails.

Figure 10:
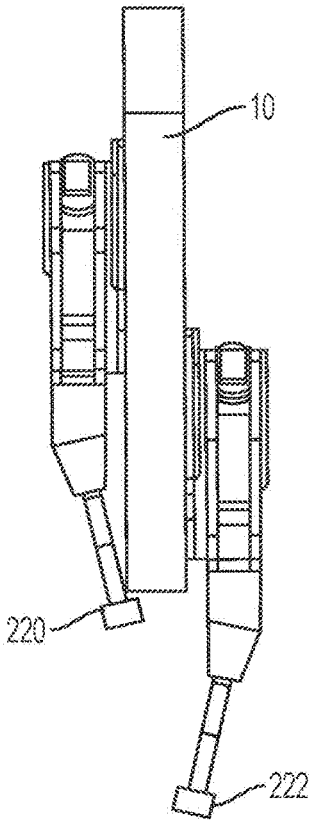
FIG. 10 illustrates a side view of the split workhead assembly of FIG. 8, wherein the tamping tools on either side of the frame are at different vertical positions.
Figure 11:
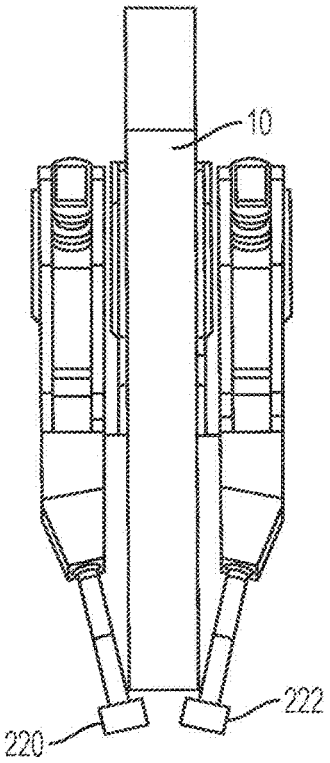
FIG. 11 illustrates a side view of the split workhead assembly of FIG. 8, wherein the tamping tools on either side of the frame are at the same vertical position.
Figure 12:
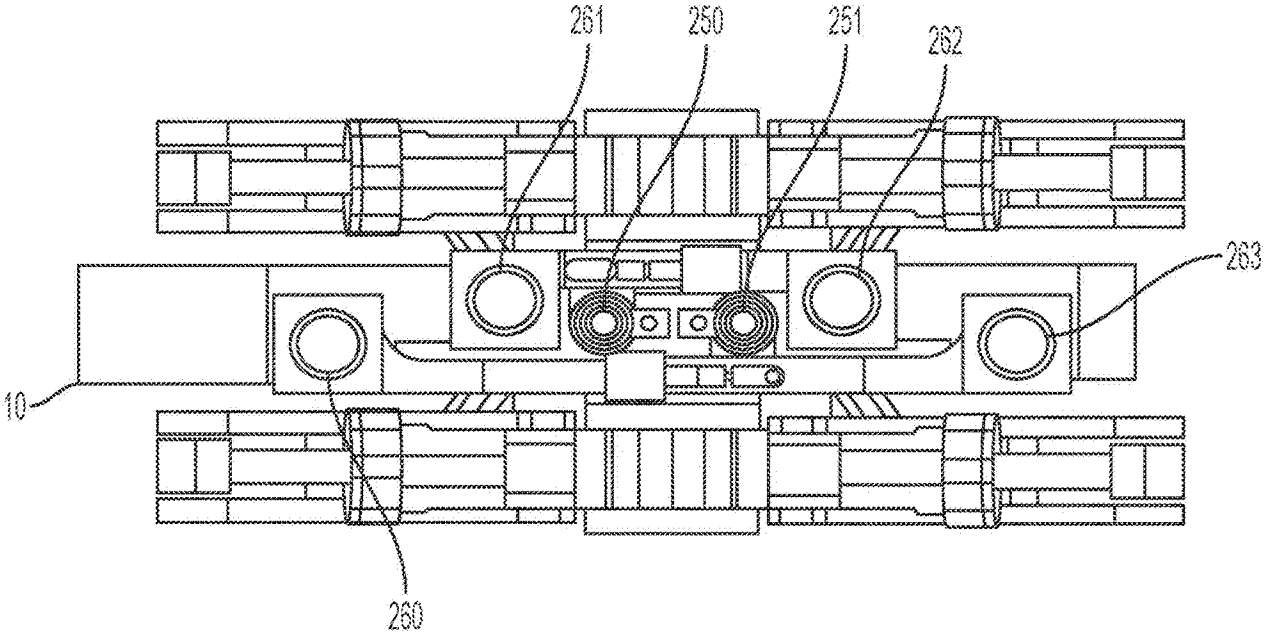
FIG. 12 illustrates a top view of the split workhead assembly of FIG. 8.

The front sub frame, 280, and back sub frame (not shown in FIGS. 8 and 9) are further each coupled to a hydraulic actuator 250 and 251, as shown in FIGS. 8, 9, and 12, that provides for independent movement of the workheads in the vertical direction. In this manner, the hydraulic actuators 250 and 251 may be actuated to independently lift the workheads 220 and 222 (via connection to a workhead frame assembly) on either side of the frame 10 as shown in FIGS. 10 and 11.

As shown in FIG. 12, the workheads on either side of the frame 10 are operatively coupled to their respective hydraulic actuator 250 and 251 to achieve independent vertical movement of the workheads relative to the workheads on the other side of the frame. Tubes 260, 261, 262, and 263 are further provided for permitting the workheads to slide up and down when the hydraulic actuators are actuated for independent vertical movement.

In another embodiment set forth in FIGS. 13-17, the split workhead assembly 300, with frame 10, includes four tamping tools, 320 and 321, and 322 and 323 (not depicted in FIGS. 13 and 14), two of each being disposed on both sides of a frame. As with the previous embodiments, additional tamping tools may be deployed. Similar to the embodiment of FIGS. 8-12, each tamping tool is coupled to a tamping arm which pivot around pivot points (312 and 313) (tamping arms 340 and 341 are shown), which is, in turn, coupled to a hydraulic actuator (cylinders 330 and 331 are shown). In some embodiments, the hydraulic actuators 330 and 331 may take the form of the double rod actuators or the single rod linear hydraulic actuators described previously. The hydraulic actuators 330 and 331 extend between their respective tamping arms 340 and 341 and a sub frame 370 such that actuation of the hydraulic actuators results in actuation of the tamping arms, and thus sweeping movement of the tamping tools.

Figure 13:
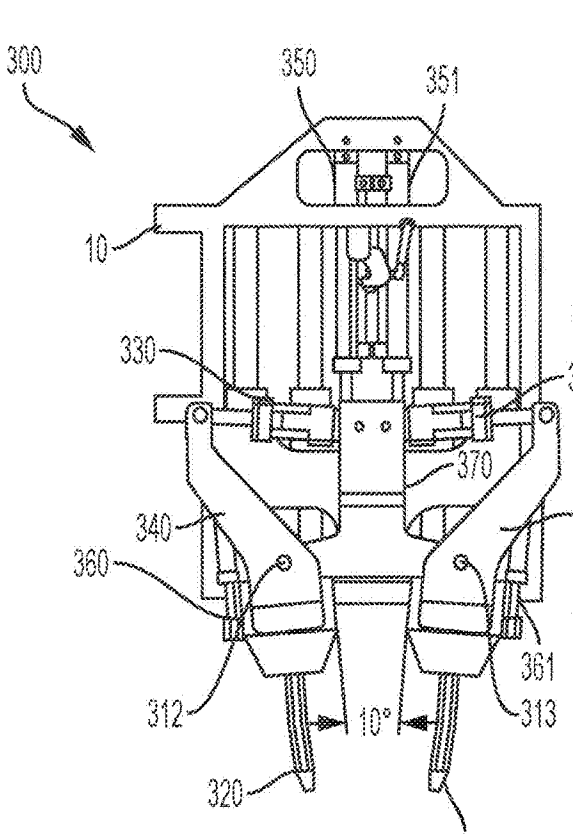
FIG. 13 illustrates a front view of a split workhead assembly with linkage arms operatively coupled to aa sub frame, with an additional actuator, according to another embodiment of the present disclosure.

As shown in FIG. 13, each hydraulic actuator 330 and 331 is actuated to increase in length to thereby impart movement to the respective tamping arms 340 and 341, and therefore the tamping tools 320 and 321, to cause vibration and squeezing of the tamping tools in a tamping operation. In this manner, the workheads can achieve a squeezing angle towards one another up to about 10 degrees as measured from a vertical side of the workhead to an axis normal to the rails. Additional hydraulic actuators 360 and 361 may be provided to impart further movement to the tamping tools 320 and 321. For example, the additional hydraulic actuators 360 and 361 may be used to lift the tamping tools 320 and 321 in a plane parallel or perpendicular to the longitudinal axis of the rail.

Figure 14:
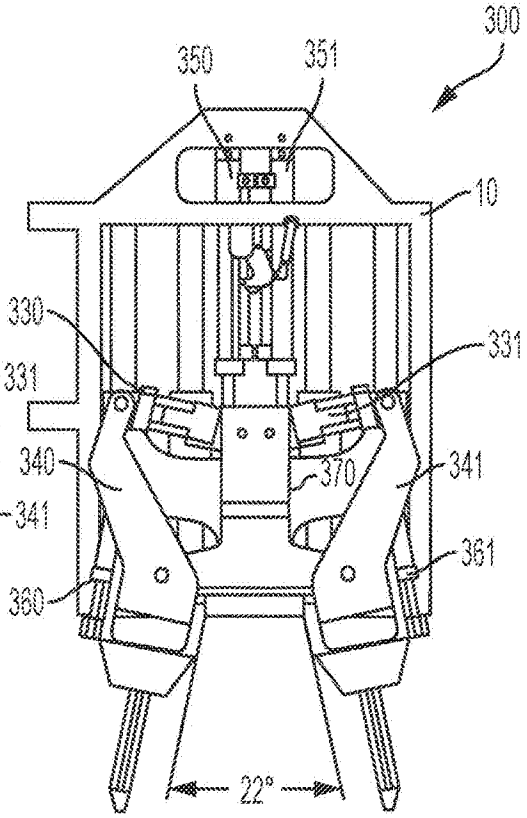
FIG. 14 illustrates a front view of the split workhead assembly of FIG. 13, wherein the tamping tools are tilted away from one another.

As shown in FIG. 14, the hydraulic actuators 330 and 331 may be actuated to decrease in length to thereby impart movement to the tamping arms 340 and 341 and therefore the tamping tools 320 and 321 to cause opening of the workheads. In this manner, the tamping tools 320 and 321 can achieve an opening operation in which the workheads are tilted away and opened from one another up to 22 degrees as measured from a vertical side of the workhead to an axis normal to the rails.

Figure 15:
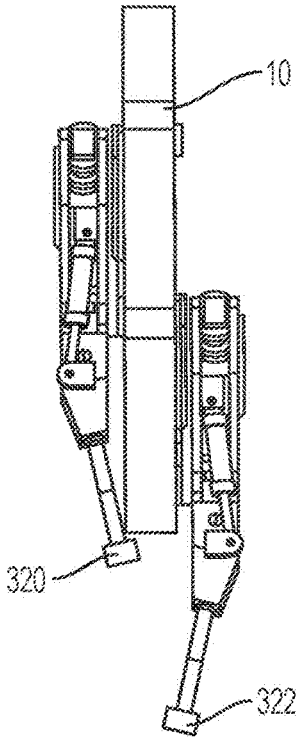
FIG. 15 illustrates a side view of the split workhead assembly of FIG. 13, wherein the tamping tools on either side of the frame are at different vertical positions.
Figure 16:
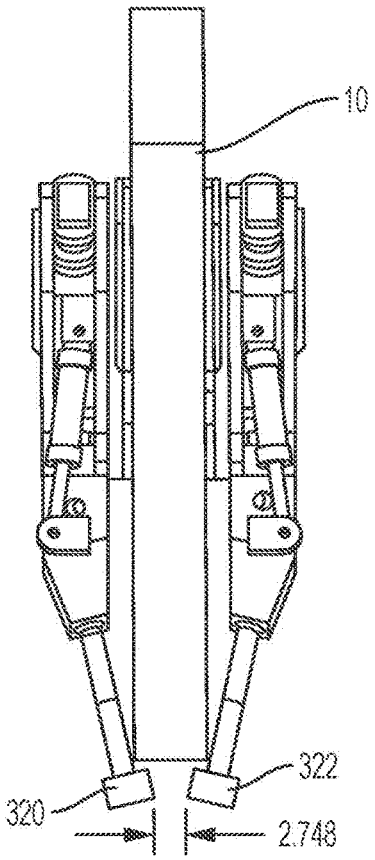
FIG. 16 illustrates a side view of the split workhead assembly of FIG. 13, wherein the tamping tools on either side of the frame are at the same vertical position.
Figure 17:
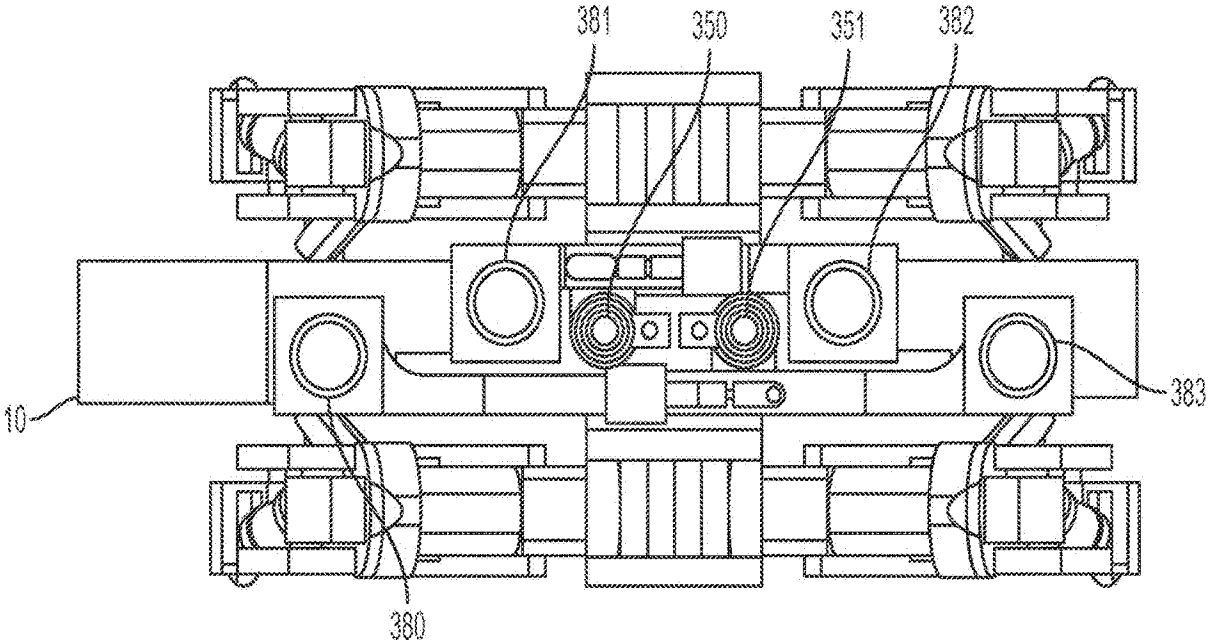
FIG. 17 illustrates a top view of the split workhead assembly of FIG. 13.

The front sub frame, 370, and back sub frame (not shown in FIGS. 13 and 14) are further each coupled to a hydraulic actuator 350 and 351, as shown in FIGS. 13, 14, and 17, that provides for independent movement of the workheads in the vertical direction. In this manner, the hydraulic actuators 350 and 351 may be actuated to independently lift the workheads 320 and 321 (via connection to a workhead frame assembly) on either side of the frame 10 as shown in FIGS. 15 and 16.

As shown in FIG. 17, the workheads on either side of the frame 10 are operatively coupled to their respective hydraulic actuator 350 and 351 that provides for independent movement of the workheads in the vertical direction. In this manner, the hydraulic actuators may be actuated to independently lift the workheads (via connection to a sub frame) on either side of the frame 10. Tubes 380, 381, 382, and 383 are further provided for permitting the workheads to slide up and down when the hydraulic actuators are actuated for independent vertical movement.

The above described embodiments of a split workhead assembly provide numerous benefits. For example, the split workhead assemblies described herein do not require a swinging tool. As a result, control boxes or signaling devices in switch areas can be avoided. Further, the designs described herein do not violate clearance envelope. Still further, the split workhead assemblies of the present disclosure facilitate easier tamping of any portion of a switch and provide for variable tamping tine spacing for ideal compaction in any switch or plainline area.

While various embodiments in accordance with the disclosed principles have been described above, it should be understood that they have been presented by way of example only, and are not limiting. For example, while exemplary specific ranges of motion are described with respect to opening and closing of the tamping tools, these are provided merely as exemplary ranges of motion associated with the present disclosure. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

We claim:

1. A workhead assembly for use in rail applications, comprising:

a frame;

a vertically-oriented actuator coupled to the frame; and a pair of linkage arms:

rotatably coupled to the vertically-oriented actuator via a connector such that the vertically-oriented actuator is configured to impart rotational movement to the linkage arms;

coupled to a pair of tamping arms; and comprising hydraulic actuators; and a pair of tamping tools coupled to the tamping arms.

2. A workhead assembly according to claim 1, wherein the pair of tamping tools are configured such that the tamping tools are capable of moving towards one another to about 10 degrees as measured from a vertical side of one of the tamping tools.

3. A workhead assembly according to claim 1, wherein the pair of tamping tools are configured such that the tamping tools are capable of tilting away from one another to open to about 22 degrees as measured from a vertical side of one of the tamping tools.

4. A workhead assembly according to claim 1, wherein the vertically-oriented actuator is operable to impart vibration to the assembly.

5. A rail vehicle comprising the workhead assembly of claim 1.

6. A workhead assembly according to claim 1, wherein the tamping tools are tynes.

7. A method of using a workhead assembly in rail applications, comprising:

providing a workhead assembly having a frame, a vertically-oriented actuator coupled to the frame, and a pair of linkage arms rotatably coupled to the vertically-oriented actuator via a connector and further coupled to a pair of tamping arms, wherein the linkage arms are hydraulic actuators; and actuating the vertically-oriented actuator to impart rotational movement to the linkage arms and to vibrate the workhead assembly.

8. A method of using a workhead assembly according to claim 7, further comprising using the linkage arms to impart independent movement to a pair of tamping tools coupled to the tamping arms by independently actuating the hydraulic actuators.

9. A split workhead assembly comprising:

a frame;

a first hydraulic actuator coupled to the frame;

a second hydraulic actuator coupled to the frame, the second hydraulic actuator being independently operable with respect to the first hydraulic actuator;

a first workhead assembly coupled to the first hydraulic actuator and disposed on a first side of the frame, the first workhead assembly comprising:

a first vertically-oriented actuator a first pair of linkage arms, each linkage arm rotatably coupled to the first vertically-oriented actuator and including a further hydraulic actuator;

a first pair of tamping arms, each tamping arm coupled to a respective one of the first pair of linkage arms; and a first pair of tamping tools coupled to the first pair of tamping arms; and a second workhead assembly coupled to the second hydraulic actuator and disposed on a second side of the frame.

10. The split workhead assembly of claim 9, wherein the first hydraulic actuator is configured to translate the first workhead assembly along a first vertical axis and the second hydraulic actuator is configured to translate the second workhead assembly along a second vertical axis.

11. The split workhead assembly of claim 9, wherein the first vertically-oriented actuator is operable to impart vibration to the first workhead assembly.

12. The split workhead assembly of claim 9, wherein the frame is coupled to a rail vehicle.

13. The split workhead assembly of claim 9, wherein the first pair of tamping tools are tynes.

14. The split workhead assembly of claim 9, wherein the second workhead assembly comprises:

a second vertically-oriented actuator coupled to the frame;

a second pair of linkage arms each coupled to the second vertically-oriented actuator;

a second pair of tamping arms coupled to the second pair of linkage arms; and a second pair of tamping tools coupled to the second pair of tamping arms.

* * * * *